US006807954B2

(12) United States Patent
Nara et al.

(10) Patent No.: US 6,807,954 B2
(45) Date of Patent: Oct. 26, 2004

(54) PORTABLE POWER WORKING MACHINE

(75) Inventors: Masato Nara, Tokyo (JP); Fujio Kobayashi, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/404,477

(22) Filed: Apr. 1, 2003

(65) Prior Publication Data

US 2003/0183208 A1 Oct. 2, 2003

(30) Foreign Application Priority Data

Apr. 2, 2002 (JP) ..... 2002/100339

(51) Int. Cl.[7] ..... F02M 34/10; B27B 17/00
(52) U.S. Cl. ..... 123/556; 123/41.05; 123/41.7
(58) Field of Search ..... 123/556, 41.05, 123/41.7

(56) References Cited

U.S. PATENT DOCUMENTS 4,249,500 A * 2/1981 Behrendt et al. ..... 123/556
4,691,681 A * 9/1987 Hoppner et al. ..... 123/556
4,716,860 A * 1/1988 Henriksson et al. ..... 123/41.05
4,765,282 A * 8/1988 Nagashima ..... 123/41.7
5,526,777 A 6/1996 Taomo et al. ..... 123/41.65

* cited by examiner

*Primary Examiner*—Marguerite J. McMahon
(74) *Attorney, Agent, or Firm*—Baker Botts LLP

(57) ABSTRACT

There is provided a portable power working machine, which is capable of rationally and effectively preventing the generation of the icing without giving rise to early clogging of air cleaner, the malfunction of a internal combustion engine and deterioration of performance. This working machine comprises a small air-cooled internal combustion engine which is mounted inside a main housing, a cooling fan disposed on one side of the main housing; a carburetor coupled to an upper portion of an intake port of the internal combustion engine; a clean air chamber disposed on an upstream side of the carburetor; an air cleaner cover coupled to the clean air chamber; a warm air introducing passageway for introducing, through a region adjacent to the intake port, part of air which has been sucked by the cooling fan for cooling the internal combustion engine into the air cleaner cover; and a shutter for and externally opening or closing the warm air introducing passageway as desired.

7 Claims, 5 Drawing Sheets

PORTABLE POWER WORKING MACHINE

BACKGROUND OF THE INVENTION

1. Field of the Invention

The present invention relates to a portable power working machine such as a chain saw, an engine cutter or a hedge trimmer, etc, wherein a small air-cooled internal combustion engine is mounted thereon as a power source for driving a working member of the working machine. In particular, the present invention relates to the portable power working machine which is capable of effectively preventing icing from generating at a intake system of the internal combustion engine especially in cold seasons.

2. Description of the Related Art

A portable power working machine such as a chain saw is generally constructed such that a small air-cooled two-stroke gasoline internal combustion engine such as a small air-cooled internal combustion engine having a displacement of about 25–100 mL is mounted in a main housing as a power source for driving the working member thereof such as a saw chain, and that a cooling fan driven by the internal combustion engine is disposed on one side of the main housing of the engine so as to permit part of the air that has been sucked into the main housing by this cooling fan to be introduced, via an air cleaner and carburetor into the internal combustion engine.

In this portable power working machine as described above, there is usually encountered with a trouble of so-called icing in cold seasons wherein the water component in the sucked outer air is caused to freeze at the components such as carburetor constituting the air intake system of the internal combustion engine; thereby giving rise to the malfunctioning of the internal combustion engine.

As for the countermeasure for the prevention of the icing, there has been considered to utilize the air that has been once sucked into the main housing by means of the cooling fan for cooling the internal combustion engine, i.e. to introduce part of the air (warm air) that has been heated by the internal combustion engine into the air cleaner and carburetor to thereby warm the air cleaner and the carburetor.

If it is desired to employ the aforementioned countermeasure wherein the air once employed for cooling the internal combustion engine and warmed up is to be introduced into the air intake system, there is a matter that should be especially taken into account particularly if the portable working machine is any one of a chain saw, an engine cutter and a hedge trimmer, etc. Namely, dust such as relatively large saw dusts, cut powder or sandy dust would be inevitably generated during the operation thereof, so that these dusts are permitted to be sucked together with air into the main housing by the cooling fan. If the air (warmed air) containing a large quantity of such dust is permitted to introduce into the air intake system of the internal combustion engine, these dusts are likely to be adhered onto the air cleaner (the filter portion thereof), thereby giving rise to the generation of clogging of the filter at an early stage of operation. As a result, the malfunction of the internal combustion engine or the deterioration in performance of the internal combustion engine would be caused due to an insufficiency of air that can be introduced into the internal combustion engine.

Furthermore, it is desirable that the air to be introduced as a medium for preventing the icing into the air intake system of the internal combustion engine should be as high in temperature as possible. However, when the internal combustion engine is operated in warm seasons where there is little possibility of generating the icing, the introduction of warmed air into the air intake system of the internal combustion engine would become unfavorable on the contrary, inviting the malfunction and the deterioration of the internal combustion engine. Therefore, it may become necessary to provide the intake system with means for switching the introduction and non-introduction of warm air to be used for the prevention of the icing.

BRIEF SUMMARY OF THE INVENTION

The present invention has been achieved in view of the aforementioned problems and hence, an object of the present invention is to provide a portable working machine which is capable of rationally and effectively preventing the generation of the icing that may be caused to generate at the air intake system of a small air-cooled internal combustion engine to be mounted thereon as a power source for driving the working component thereof without giving rise to early clogging of an air cleaner, to the malfunction of the internal combustion engine, or to the deterioration of performance.

With a view to realize the aforementioned object, there is provided, according to the present invention, a portable power working machine, which comprises a small air-cooled internal combustion engine mounted inside a main housing; a cooling fan disposed on one side of the main housing and designed to be driven by means of said internal combustion engine; a carburetor coupled to an upper portion of an intake port of said internal combustion engine; a clean air chamber disposed on an upstream side of said carburetor; an air cleaner cover coupled to said clean air chamber; a warm air introducing passageway for introducing, through a region adjacent to said intake port, part of air which has been inhaled by said cooling fan for cooling said internal combustion engine into said air cleaner cover, and a shutter for externally opening or closing said warm air introducing passageway as desired.

According to a preferable embodiment of the present invention, the internal combustion engine is mounted in such a manner that a cylinder thereof is disposed lateral with said intake port being disposed upward and a head portion thereof being disposed rearward.

In a preferable embodiment, a laterally L-shaped top handle is disposed over an upper surface of said main housing, and a rear upright portion of said top handle is provided with said carburetor, said clean air chamber, and a downstream portion of said warm air introducing passageway.

The warm air introducing passageway is preferably disposed on the other side of said main housing which is opposite to said one side of said main housing as well as on the other side of said rear upright portion which is opposite to said one side of said main housing, so that air warmed by the internal combustion engine is permitted to pass, through said other sides of said carburetor and of said clean air chamber, to an upper portion of an external air chamber formed inside said air cleaner cover.

In another preferable embodiment, an inlet port for said warm air introducing passageway is provided adjacent to said intake port disposed at a cooling air guide cover enclosing a cylinder portion of said internal combustion engine, and said shutter is disposed to open and close said inlet port.

The air cleaner cover should preferably be formed of a cap-like configuration, an interior of which is communicated, through a filter member functioning as a partitioning wall, with said clean air chamber, this air cleaner cover being detachably secured to a rear end portion of said rear upright portion.

As for the portable power working machine to which the present invention can be applied, a typical example thereof would be a chain saw which is provided, on the aforementioned other side of the main housing, with a saw chain set constituted by a saw chain and a guide bar, thereby enabling to discharge a large quantity of dust such as saw dust during the operation thereof.

According to preferable embodiments of the portable power working machine which have been constructed according to the present invention, in cold seasons where the aforementioned phenomenon of icing may be permitted to occur, the shutter for opening and closing the inlet port of the warm air introducing passageway provided close to the intake port at the cooling air guide cover enclosing the cylinder portion of the internal combustion engine is externally operated so as to open the shutter. As a result, part of the air that has been sucked by means of the cooling fan for cooling the internal combustion engine (i.e. the air (warm air) that has been warmed by the internal combustion engine) is permitted to enter from the inlet port located close to the intake port into the warm air introducing passageway and then, introduced into the air cleaner cover, in which dust that may be included in the air is removed at the filter member disposed inside the air cleaner cover. Thereafter, the resultant air is permitted to pass through the clean air chamber and the carburetor and introduced through the intake port. As explained above, since the air intake system constituted by the air cleaner and the carburetor, etc. can be warmed up by the warmed air, the generation of icing can be rationally and effectively prevented.

In this case, since the air that has been introduced into the warm air introducing passageway from a region close to the intake port is heated higher than the air disposed at a region which is located below the warm air introducing passageway, it contains a reduced quantity of dust due to the effects of gravity and inertia, and the air intake system can be rapidly warmed up by the warmed air without giving rise to early clogging of the filter member disposed inside the air cleaner cover, to the malfunction of the internal combustion engine, or to the deterioration of performance.

DETAILED DESCRIPTION OF THE INVENTION

Figure 1:
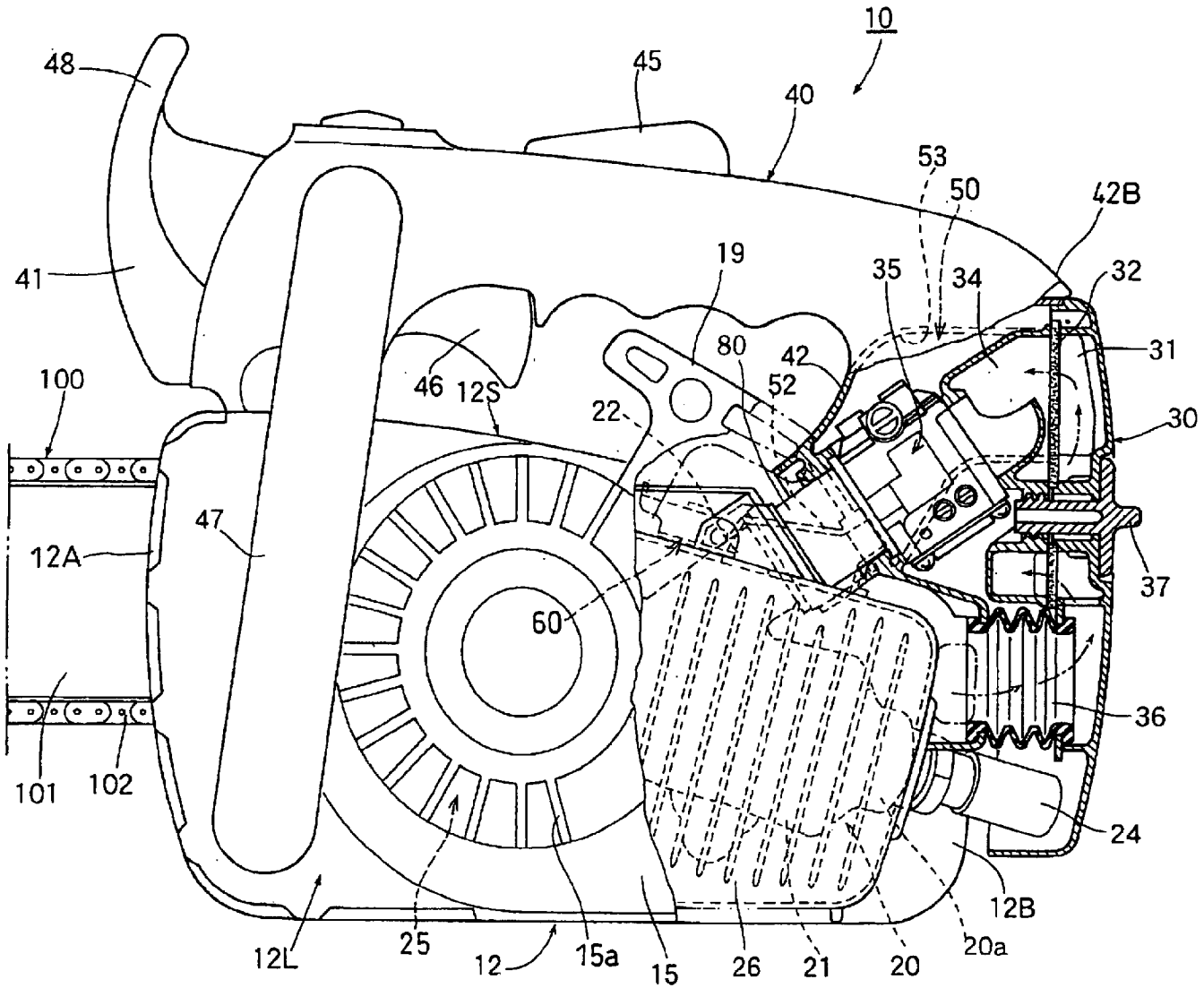
FIG. 1 is a partially sectioned left side view of a chain saw representing one embodiment of the portable power working machine according to the present invention.
Figure 2:
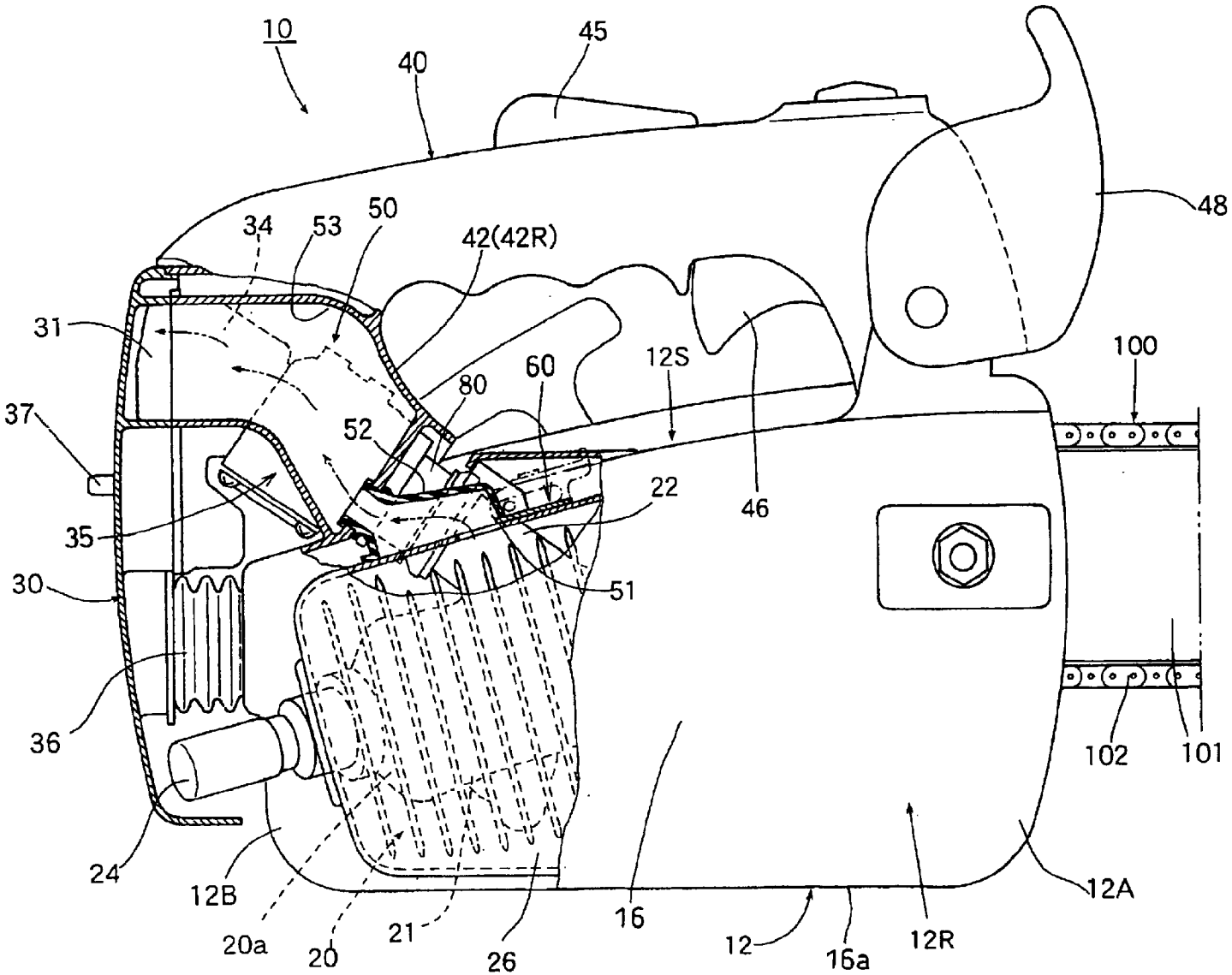
FIG. 2 is a partially sectioned right side view of the chain saw shown in FIG .1.
Figure 3:
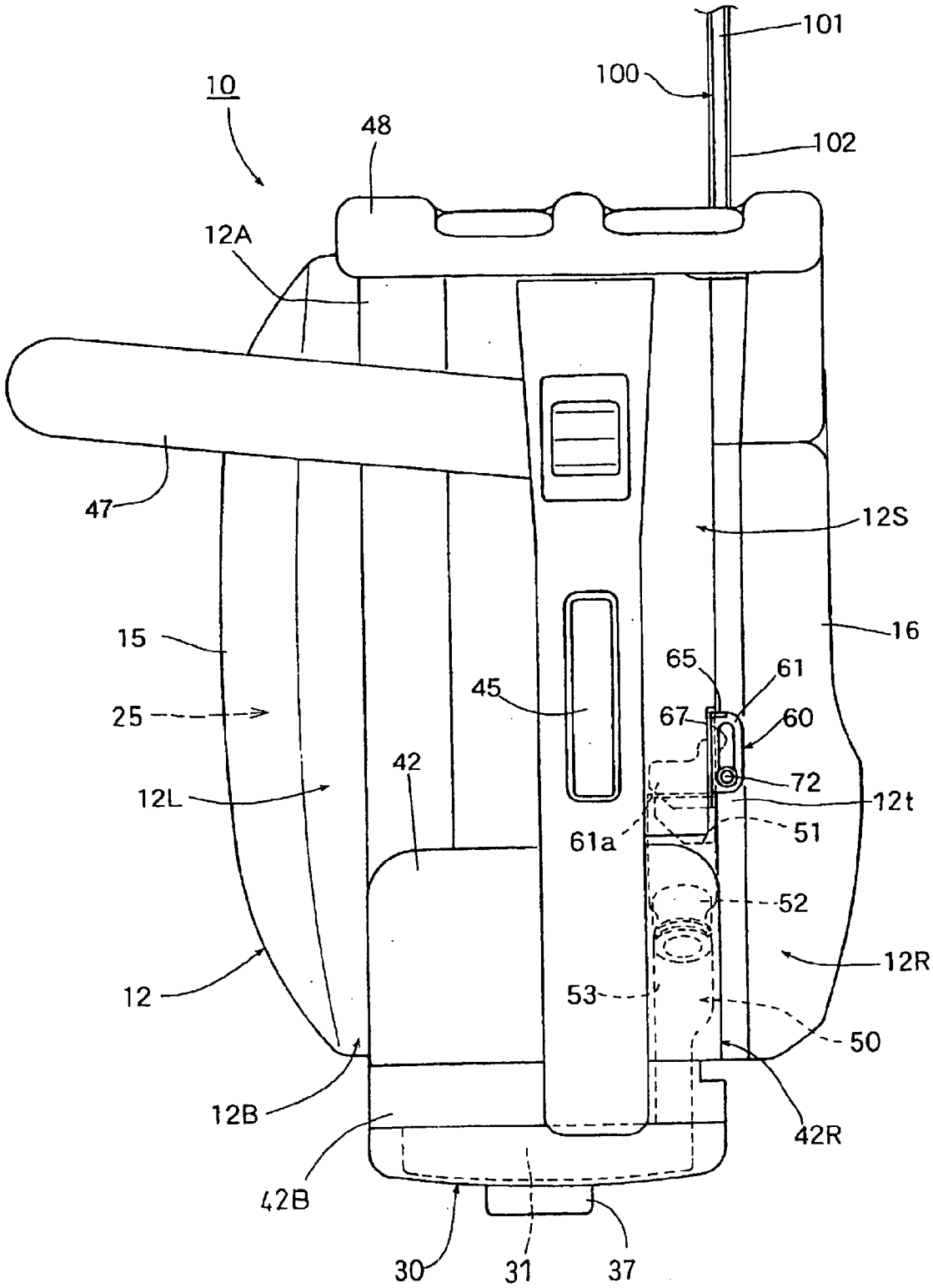
FIG. 3 is a plan view of the chain saw shown in FIG. 1.

Next, one embodiment according to the present invention will be explained in detail with reference to drawings.

The chain saw 10 shown in these figures comprises a small air-cooled internal combustion engine (referred to hereinafter as internal combustion engine) 20 acting as a power source for driving the working components and is mounted inside the main housing 12 made of plastic in such a manner that the cylinder portion 21 thereof is disposed laterally with its intake port (boss portion) 22 being disposed upward and its head portion 20*a* being disposed rearward of the chain saw 10. The head portion 20*a* of the internal combustion engine 20 is provided with an ignition plug 24 which is inclined obliquely rearward, and with a cooling air guide cover 26 which is disposed to enclose the cylinder portion 21.

A cooling fan 25 is disposed on one side or the left side 12L of the main housing 12 and designed to be driven by means of the internal combustion engine 20. A recoil starter case 15 having a large number of air intake slits 15a formed therein is secured to the left side 12L of the main housing 12 so as to cover the cooling fan 25.

A clutch cover 16 is secured to the other side or the right side 12R (opposite side to the left side 12L) of the main housing 12. On the forward side of the clutch cover 16, there is attached, as the working component thereof, a chain saw 100 which is constituted by a guide bar 101, and a saw chain 102 which is slidably wound around the guide bar 101. The saw chain 102 is designed to be rotated through a centrifugal clutch (not shown) by means of the internal combustion engine 20.

On the other hand, by making use of suitable vibration proof means (not shown), a laterally L-shaped top handle 40 having a throttle lock lever 45 and a throttle trigger 46 incorporated therewith is disposed extending over a top surface (12S) and a rear portion 12B of the main housing 12. On the forward side of a top handle 40, there are disposed a fore-handle 47 and a hand cover 48. The rear upside portion 42 of the top handle 40 is shaped into a box-like configuration having a wide top face, the width of which is larger than that of other faces.

The intake port 22 of the internal combustion engine 20 is protruded rearward from the top surface 12S of the main housing 12 so as to extend upward obliquely. An upper portion of the intake port 22 is communicated via a vibration-absorbing pipe 80 made of a synthetic rubber with a diaphragm type carburetor 35. A clean air chamber 34 is defined on the upstream side of the carburetor 35 and disposed contiguous to the air cleaner cover 30. These carburetor 35 and clean air chamber 34 are disposed within the rear upside portion 42 of the top handle 40. This air cleaner cover 30 is cap-like in configuration and disposed contiguous, via a filter member 32 disposed inside the air cleaner cover 30 so as to act also as a partitioning wall, to the clean air chamber 34. This air cleaner cover 30 is detachably secured by means of a screw member 37 to a rear end portion 42B of the rear upright portion 42.

In this embodiment, there is provided, as means for preventing the generation of the icing, a warm air introducing passageway 50 so as to enable part of the air that has been sucked by the cooling fan 25 for cooling the internal combustion engine 20 to be introduced into the interior of the air cleaner cover 30 from a region located close to the intake port 22. Then, a shutter 60 is provided so as to enable the warm air introducing passageway 50 to be opened or closed as desired by externally manipulating it.

This warm air introducing passageway 50 is positioned on the right sides 12R, 42R of the rear upright portion 42 of the main housing 12 and of the top handle 40, so that the air warmed is enabled to flow, through a region located on an outer side of the carburetor 35 and the clean air chamber 34, into an upper portion of the external air chamber 31 formed inside the air cleaner cover 30.

Specifically, an inlet port 51 for the warm air introducing passageway 50 is provided adjacent to the intake port 22 disposed at the upper surface of the cooling air guide cover 26 enclosing a cylinder portion 21 of the internal combustion engine 20, this inlet port 51 being designed to be opened or closed by a shutter 60 disposed nearby. This warm air introducing passageway 50 is constituted by a vibration-absorbing guide pipe 52 made of a synthetic material and having a reverse funnel-like configuration so as to cover, from the top, the inlet port 51, and a downstream passageway 53 which is formed inside the right side portion 42R of the rear upright portion 42 of the top handle 40.

Figure 4:
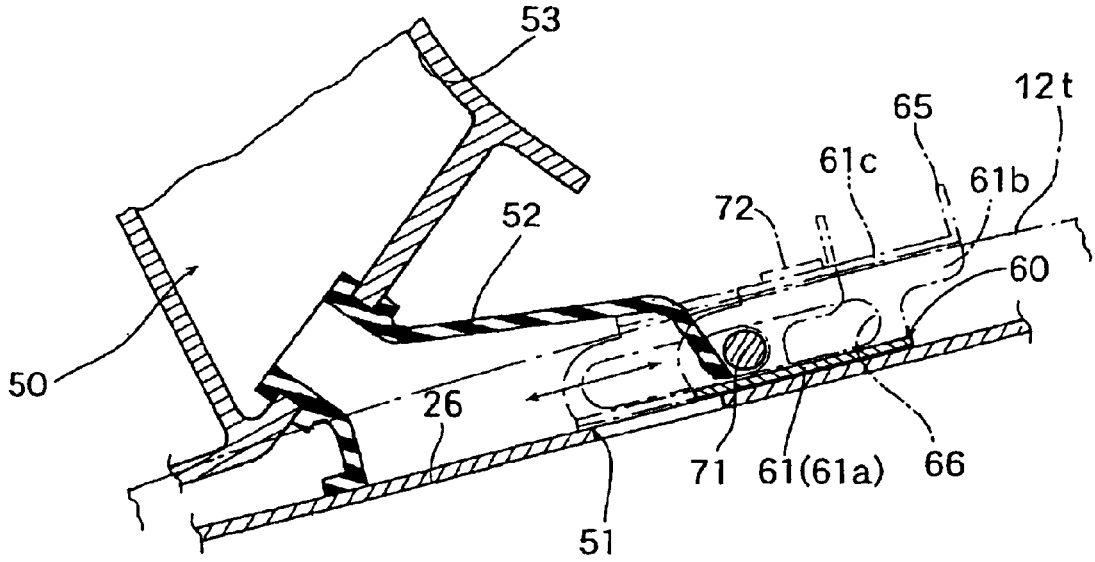
FIG. 4 is an enlarged side view of the shutter shown in FIG. 2.
Figure 5:
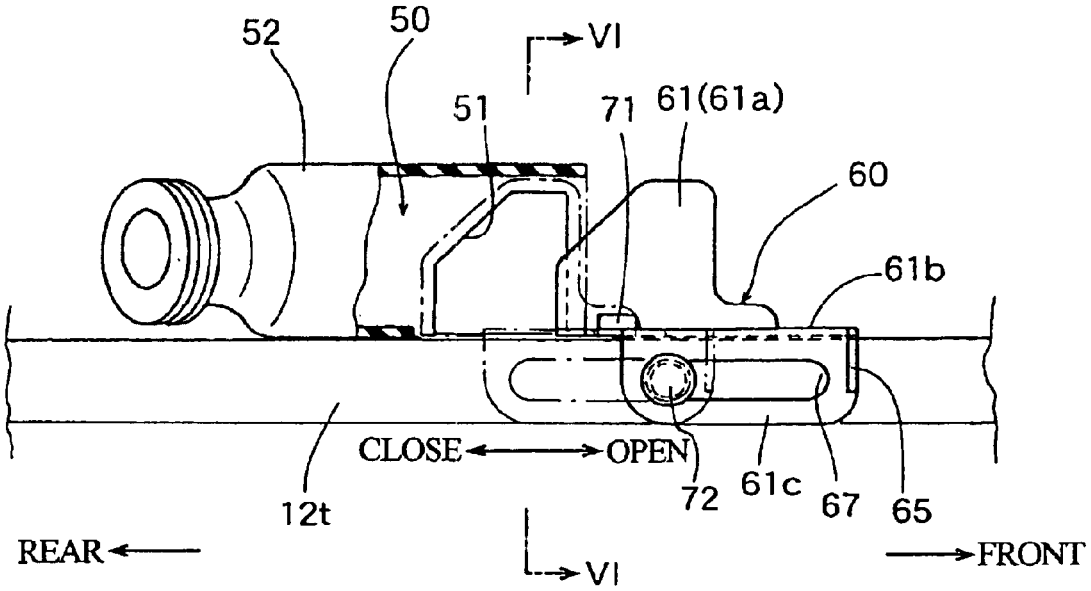
FIG. 5 is an enlarged plan view of the shutter shown in FIG. 4.
Figure 6:
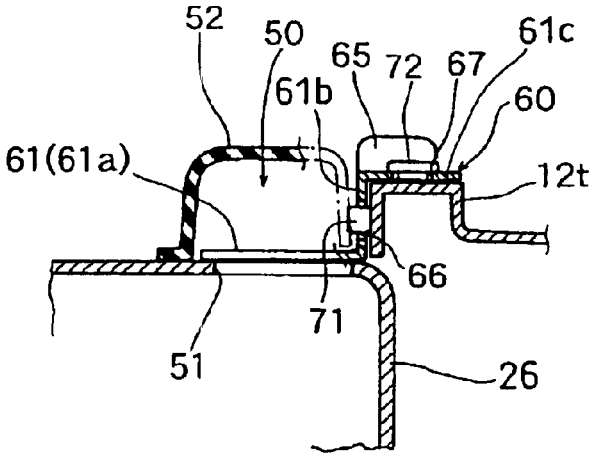
FIG. 6 is a sectional view taken along the line VI—VI of FIG. 5.

As shown in FIGS. 4, 5 and 6, the shutter 60 is provided with a shutter plate 61 having an angle-like cross-sectional configuration and being enabled to slide on the surface of a projected portion 12*t* formed on the top surface 12S of the main housing 12 as well as on the surface of the cooling air guide cover 26.

Namely, this shutter plate 61 constituted by a closing plate portion 61*a* having a configuration (trapezoid) which is similar to the inlet port 51 and a size large enough to close the inlet port 51, an intermediate plate portion 61*b* formed contiguous to and being bent by the right angle from the closing plate portion 61*a* and designed to be contacted with the sidewall of the projected portion 12*t*, and an externally operable surface portion 61*c* formed contiguous to and being bent by the right angle from the intermediate plate portion 61*b* and designed to be contacted with the upper surface of the projected portion 12*t*. A finger grip 65 for sliding the shutter plate 61 is provided integral with the fore-end portion of the externally operable surface portion 61*c*.

Further, in order to enable the shutter plate 61 to precisely linearly slide back and forth on the surface of the projected portion 12*t* and on the surface of the cooling air guide cover 26, a guide pin 71 is projected from the sidewall of the projected portion 12*t*. Namely, this guide pin 71 is designed to be fitted in a slot 66 formed in the intermediate plate portion 61*b* and extending in the longitudinal direction of the shutter plate 61. Further, in order to prevent the externally operable surface portion 61*c* from rising from the upper surface of the projected portion 12*t*, a circular head-attached guide pin 72 is projected from the upper surface of the projected portion 12*t* and fitted in a slot 67 formed in the externally operable surface portion 61*c* and extending in the longitudinal direction of the shutter plate 61.

By the way, if required, it is also possible to employ any click stop means for holding the opened or closed position of the shutter 60.

When the shutter 60 is moved to the forward position (the position indicted by a solid line in FIGS. 4 and 5), the inlet port 51 can be opened, while when the shutter 60 is moved to the rearward position (the position indicted by a dashed line in FIGS. 4 and 5), the inlet port 51 can be closed.

Therefore, if the chain saw 10 according to this embodiment is to be employed in warm seasons where there is no possibility of generating the icing, the shutter 60 is moved to the rearward position so as to close the inlet port 51. On this occasion, the air that has been sucked inside the main housing 12 by means of the cooling fan 25 is guided by means of the cooling air guide cover 26 so as to be used for cooling the internal combustion engine 20. The air heated due to the employment thereof for cooling the internal combustion engine is permitted to be discharged into the external atmosphere from the serrated outlet port 16a of the clutch cover 16, then, as indicated by a two-dot chain line shown in FIG. 1, part of the air that has been sucked inside the main housing 12 is guided to the external air chamber 31 by means of a vibration-absorbing bellows 36 made of synthetic rubber and disposed at a lower left portion of the rear portion 12B of the main housing 12. The air that has been introduced into the external air chamber 31 is moved upward and passed through the filter 32 so as to remove any dust that may be included therein, after which the resultant clean air is permitted to enter into the clean air chamber 34. Thereafter, the air is introduced via the carburetor 35 and the intake port 22 into the internal combustion engine 20.

On the other hand, if the chain saw 10 according to this embodiment is to be employed in cold seasons where there is a possibility of generating the icing, the shutter 60 is moved to its forward position so as to open the inlet port 51. As a result, part of the air that has been sucked by means of the cooling fan 25 and used for cooling the internal combustion engine 20, i.e. the air heated by the internal combustion engine (warm air) is permitted to enter, through the inlet port 51, into the warm air introducing passageway 50 from a region located in the vicinity of the intake port 22. Thereafter, the air is permitted to flow from the warm air introducing passageway 50 to an upper portion of the external air chamber 31 formed inside the air cleaner cover 30 so as to remove dust included therein by means of the filter member 32. Then, the resultant clean air is permitted to pass through the clean air chamber 34 and the carburetor 35 and turned into a fuel-air mixture, which is then introduced from the intake port 22 into the internal combustion engine 20. As a result, the air intake system constituted by the air cleaner cover 30 and the carburetor 35 can be heated up by this warm air, thereby making it possible to rationally and effectively preventing the generation of the icing.

In this case, since the air that has been introduced into the warm air introducing passageway 50 from a region close to the intake port 22 is heated higher than the air disposed at a region which is located below the warm air introducing passageway 50, it contains a reduced quantity of dust due to the effects of gravity and inertia, and the air intake system can be rapidly warmed up by the warmed air without giving rise to early clogging of the filter member 32 disposed inside the air cleaner cover 30, to the malfunction of the internal combustion engine, or to the deterioration of performance.

While in the foregoing one embodiment of this invention has been explained in details for the purpose of illustration, it will be understood that the construction of the device can be varied without departing from the spirit and scope of the invention.

For example, in the foregoing embodiment, the explanation thereof is directed to the case where the present invention is applied to a chain saw. However, the present invention is also applicable, other than the chain saw, to various kinds of portable power working machines such as an engine cutter, and a hedge trimmer, etc.

As apparent from above explanation, in the case of the portable working machine according to the present invention, it is possible, without giving rise to early clogging of air cleaner, the malfunction of the internal combustion engine and the deterioration of performance, to rationally and effectively prevent the generation of the icing that may be caused to generate at the intake system of a small air-cooled internal combustion engine to be mounted thereon as a power source for driving the working component thereof.

What is claimed is:

1. A portable power working machine, comprising a small air-cooled internal combustion engine mounted inside a main housing; a cooling fan disposed on one side of said main housing and driven by said internal combustion engine; a carburetor coupled to an upper portion of an intake port of said internal combustion engine; a clean air chamber disposed on an upstream side of said carburetor; an air cleaner cover coupled to said clean air chamber; a warm air introducing passageway for introducing interior to said air cleaner cover, through a region adjacent to said intake port, some of the air sucked by said cooling fan and used for cooling said internal combustion engine; and a shutter for externally opening or closing said warm air introducing passageway as desired wherein an inlet port for said warm air introducing passageway is provided adjacent to said intake port disposed at a cooling air guide cover enclosing a cylinder portion of said internal combustion engine, and said shutter is disposed to open and close said inlet port.

2. A portable power working machine, comprising a small air-cooled internal combustion engine mounted inside a main housing; a cooling fan disposed on one side of said main housing and driven by said internal combustion engine; a carburetor coupled to an upper portion of an intake port of said internal combustion engine; a clean air chamber disposed on an upstream side of said carburetor; an air cleaner cover coupled to said clean air chamber; a warm air introducing passageway for introducing interior to said air cleaner cover, through a region adjacent to said intake port, some of the air sucked by said cooling fan and used for cooling said internal combustion engine; and a shutter for externally opening or closing said warm air introducing passageway as desired;

wherein a laterally L-shaped top handle is disposed over an upper surface of said main housing, and a rear upright portion of said top handle is provided with said carburetor, said clean air chamber, and a downstream portion of said warm air introducing passageway.

3. The portable power working machine according to claim 2, wherein said main housing includes at least a rearward end and an upward end; wherein said internal combustion engine is mounted in such a manner that a cylinder portion thereof is disposed parallel to a lateral surface of said main housing, with said intake port being disposed towards said upward end of said main housing and a head portion thereof being disposed towards the rearward end of said main housing.

4. The portable power working machine according to claim 2, wherein said warm air introducing passageway is disposed on the other side of said main housing which is opposite to said one side of said main housing as well as on the other side of said rear upright portion which is opposite to said one side of said main housing, so that air warmed by the internal combustion engine is permitted to pass through said other sides of said carburetor and of said clean air chamber to an upper portion of an external air chamber formed inside said air cleaner cover.

5. The portable power working machine according to claim 2, wherein an inlet port for said warm air introducing passageway is provided adjacent to said intake port disposed at a cooling air guide cover enclosing a cylinder portion of said internal combustion engine, and said shutter is disposed to open and close said inlet port.

6. The portable power working machine according to claim 2, wherein said main housing includes at least a rear upright portion; wherein said air cleaner cover is formed of a cap-like configuration, an interior of which is communicated, through a filter member functioning as a partitioning wall, with said clean air chamber, said air cleaner cover being detachably secured to a rear end portion of said rear upright portion of said main housing.

7. The portable power working machine according to claim 2, wherein said main housing includes at least a forward end, said power working machine further comprising a saw chain set comprising a saw chain and a guide bar, which are provided in front of said forward end of said main housing.

* * * * *